US007159652B2

(12) United States Patent
McGuire et al.

(10) Patent No.: US 7,159,652 B2
(45) Date of Patent: Jan. 9, 2007

(54) DRILLING FLANGE AND INDEPENDENT SCREWED WELLHEAD WITH METAL-TO-METAL SEAL AND METHOD OF USE

(75) Inventors: Bob McGuire, Oklahoma City, OK (US); L. Murray Dallas, Fairview, TX (US)

(73) Assignee: Oil States Energy Services, Inc., Houston, TX (US)

( * ) Notice: Subject to any disclaimer, the term of this patent is extended or adjusted under 35 U.S.C. 154(b) by 242 days.

(21) Appl. No.: 10/656,693

(22) Filed: Sep. 4, 2003

(65) Prior Publication Data

US 2005/0051362 A1 Mar. 10, 2005

(51) Int. Cl.
*E21B 33/03* (2006.01)

(52) U.S. Cl. ..... 166/85.1; 166/75.13; 166/379

(58) Field of Classification Search ..... 166/382, 166/379, 77.1, 85.1, 85.4, 88.1, 78.1, 75.13, 166/75.14; 175/162, 195, 57; 285/123.7, 285/349, 368, 414, 123.12, 123.13, 123.14, 285/363, 378, 379, 380
See application file for complete search history.

(56) References Cited

U.S. PATENT DOCUMENTS

| | | | | |
|---|---|---|---|---|
| 2,109,031 | A | 2/1938 | O'Neal | 285/123.9 |
| 3,158,389 | A | 11/1964 | Turner | 285/123.3 |
| 3,343,603 | A | 9/1967 | Miller | 166/46 |
| 3,637,223 | A * | 1/1972 | Weber | 277/608 |
| 3,675,719 | A | 7/1972 | Slator, et al. | 166/297 |
| 4,159,135 | A * | 6/1979 | Richardson | 285/336 |
| 4,281,724 | A * | 8/1981 | Garrett | 175/195 |
| 4,353,420 | A | 10/1982 | Miller | 166/382 |
| 4,657,075 | A * | 4/1987 | McLeod | 166/72 |
| 4,690,221 | A * | 9/1987 | Ritter, Jr. | 166/382 |
| 4,993,488 | A | 2/1991 | McLeod | 166/72 |
| 5,092,401 | A | 3/1992 | Heynen | 166/89 |
| 5,103,900 | A | 4/1992 | McLeod et al. | 166/88.1 |
| 5,388,639 | A * | 2/1995 | Betchan et al. | 166/85.1 |
| 5,492,373 | A * | 2/1996 | Smith | 285/148.19 |
| 5,605,194 | A | 2/1997 | Smith | |
| 5,660,234 | A | 8/1997 | Hebert et al. | 166/368 |
| 6,179,053 | B1 * | 1/2001 | Dallas | 166/77.51 |
| 6,196,323 | B1 | 3/2001 | M.o slashed.ksvold | 166/368 |
| 6,199,914 | B1 | 3/2001 | Duhn | |
| 6,220,363 | B1 | 4/2001 | Dallas | 166/382 |
| 6,247,537 | B1 | 6/2001 | Dallas | 166/379 |
| 6,289,993 | B1 * | 9/2001 | Dallas | 166/386 |
| 6,299,216 | B1 * | 10/2001 | Thompson | 285/93 |
| 6,364,024 | B1 * | 4/2002 | Dallas | 166/379 |
| 6,491,098 | B1 | 12/2002 | Dallas | 166/297 |
| 6,557,629 | B1 | 5/2003 | Wong et al. | 166/76.1 |
| 6,626,245 | B1 * | 9/2003 | Dallas | 166/379 |
| 6,637,514 | B1 * | 10/2003 | Donald et al. | 166/368 |
| 6,769,489 | B1 | 8/2004 | Dallas | 166/386 |
| 6,817,421 | B1 | 11/2004 | Dallas | 166/379 |

(Continued)

*Primary Examiner*—Kenneth Thompson
(74) *Attorney, Agent, or Firm*—Nelson Mullins Riley & Scarborough, LLP

(57) ABSTRACT

A drilling flange and an independent screwed wellhead provides a metal-to-metal seal that supplements the traditional elastomeric O-rings for providing a fluid seal between the drilling flange and the wellhead. The metal-to-metal seal may be achieved using a metal ring gasket or two contacting metal surfaces that are machined to required tolerances and are configured to be forced together when the drilling flange is mounted to the wellhead. The metal-to-metal seal ensures a fluid seal between the flange body and the wellhead in the event that the O-rings malfunction or are destroyed by fire.

26 Claims, 7 Drawing Sheets

U.S. PATENT DOCUMENTS

| | | | | |
|---|---|---|---|---|
| 6,817,423 | B1 | 11/2004 | Dallas | 166/382 |
| 6,918,439 | B1 | 7/2005 | Dallas | 166/85.3 |
| 6,938,696 | B1 | 9/2005 | Dallas | 166/377 |
| 6,948,565 | B1 | 9/2005 | Dallas | 166/382 |
| 2003/0221844 | A1* | 12/2003 | Murray | 166/381 |
| 2004/0090016 | A1* | 5/2004 | Sharp | 277/603 |
| 2004/0231856 | A1* | 11/2004 | Dallas et al. | 166/379 |
| 2004/0262012 | A1 | 12/2004 | McGuire et al. | 166/370 |
| 2005/0006103 | A1* | 1/2005 | McGuire et al. | 166/379 |
| 2005/0082829 | A1* | 4/2005 | Dallas | 285/354 |

* cited by examiner

DRILLING FLANGE AND INDEPENDENT SCREWED WELLHEAD WITH METAL-TO-METAL SEAL AND METHOD OF USE

CROSS-REFERENCE TO RELATED APPLICATIONS

This is the first application filed for the present invention.

MICROFICHE APPENDIX

Not Applicable.

TECHNICAL FIELD

The present invention relates generally to independent screwed wellhead assemblies and, in particular, to a drilling flange and independent screwed wellhead with a metal-to-metal seal for use in hydrocarbon well drilling.

BACKGROUND OF THE INVENTION

Independent screwed wellheads are well known in the art. The American Petroleum Institute (API) classifies a wellhead as an "independent screwed wellhead" if it possesses the features set out in API Specification 6A as described in U.S. Pat. No. 5,605,194 (Smith) entitled Independent Screwed Wellhead with High Pressure Capability and Method.

The independent screwed wellhead has independently secured heads for each tubular string supported in the well bore. The pressure within the casing is controlled by a blowout preventer (BOP) typically secured atop the wellhead. The head is said to be "independently" secured to a respective tubular string because it is not directly flanged or similarly affixed to the casing head. Independent screwed wellheads are widely used for production from low-pressure productions zones because they are economical to construct and maintain.

U.S. Pat. No. 6,199,914 (Duhn) entitled Drilling Quick Connectors discloses quick-connector fittings for rapid connection and disconnection of a drilling flange for an independent screwed wellhead. This patent is illustrative of the state of the art in drilling flanges for such wellheads.

Prior art drilling flanges for independent screwed wellheads suffer from one significant drawback. Because they are designed to contain well pressure using only elastomeric O-ring seals, they are vulnerable to fire and other environmental hazards that can cause the O-ring to malfunction. During drilling operations, sparks from the drill have been known to ignite hydrocarbons in the well, causing fires that can damage the elastomeric O-rings that provide the fluid seal between the drilling flange and the wellhead. If those O-ring seals are substantially damaged, the fluid seal is lost and oil or gas may leak from the interface between the wellhead and the drilling flange. Such leaks are undesirable and potentially dangerous.

There therefore exists a need for a drilling flange for use in an independent screwed wellhead that provides a metal-to-metal seal to ensure that a fluid seal is maintained between the wellhead and the drilling flange, even in the event of a fire on the wellhead.

SUMMARY OF THE INVENTION

It is therefore an object of the present invention to provide a drilling flange and an independent screwed wellhead that provides a metal-to-metal seal.

The present invention therefore provides a drilling flange for use with an independent screwed wellhead. The drilling flange comprises a flange body having a generally annular shape, the flange body including an axial passageway with an internal diameter at least as large as a passageway through the wellhead. A bottom end of the drilling flange is adapted to be mounted to a top of the independent screwed wellhead. The bottom end of the flange body includes an annular shoulder for rotatably supporting a lockdown nut for securing the flange body to the wellhead. A metal-to-metal seal provides a fluid seal between the flange body and the wellhead.

An elastomeric seal, such as an O-ring, may also be used to provide a further fluid seal between the flange body and the wellhead.

The metal-to-metal seal may be a metal ring gasket, or provided by a first metal contact surface on a bottom end of the drill flange that cooperates with a second metal contact surface on the independent screwed wellhead. The first and second metal contact surfaces are forced together by the lockdown nut to provide the metal-to-metal seal when the drilling flange is mounted to the independent screwed wellhead.

The drilling flange further comprises a wear bushing for guiding a drill string through the wellhead. The wear bushing is removably secured to a top of the axial passageway to facilitate replacement of the wear bushing. The wear busing includes a peripheral groove in an outer surface thereof, and the wear bushing is removably secured to the flange body by a plurality of locking screws received in threaded radial bores through a top end of the flange body.

The drilling flange further comprises a top flange for mounting a blowout preventer to the independent screwed wellhead.

The invention further provides a drilling assembly that comprises an independent screwed wellhead secured to a well, and a drilling that includes a flange body having a generally annular shape, the flange body including an axial passageway with an internal diameter at least as large as a passageway through the wellhead. The flange body has a bottom end adapted to be mounted to a top of the independent screwed wellhead. A sidewall of the bottom end of the flange body includes an annular shoulder for supporting a lockdown nut. The lockdown nut secures the flange body to the wellhead, and a metal-to-metal seal provides a fluid seal between the flange body and the wellhead. An elastomeric seal provides a further fluid seal between the flange body and the wellhead.

The independent screwed wellhead further comprises a lower abutment surface, an upper abutment surface, and a lateral contact surface between the lower abutment surface and the upper abutment surface. The drilling flange contacts the wellhead at the lower abutment surface, the upper abutment surface and the lateral contact surface.

The invention further provides a method of drilling a well bore that communicates with at least one hydrocarbon formation. The method comprises steps of securing an independent screwed wellhead to a surface casing for the well bore; attaching a drilling flange to the independent screwed wellhead such that a metal-to-metal seal is formed between the drilling flange and the independent screwed wellhead to provide a fluid seal between the drilling flange and the independent screwed wellhead even in the event of a fire on the wellhead; inserting a drill string through an axial passageway of the drilling flange; and rotating the drill string to drill down to the at least one hydrocarbon formation.

The invention further provides a drilling flange for an independent screwed wellhead, comprising a generally annular flange body having a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to a top of the independent screwed wellhead, the bottom end including an annular groove for receiving a metal ring gasket for providing a metal-to-metal seal between the drilling flange and the independent screwed wellhead.

The invention also provides a drilling flange and an independent screwed wellhead in combination, comprising a drilling flange having a generally annular flange body with a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to the independent screwed wellhead, the bottom end including a first annular groove for receiving an upper half of a metal ring gasket; and an independent screwed wellhead comprising a top end to which the drilling flange is mounted, the top end including a second, complimentary annular groove for receiving a lower half of the metal ring gasket. When the drilling flange is mounted to the independent screwed wellhead and the lockdown nut is tightened, the metal flange gasket is compressed in the first and second annular grooves to provide a metal-to-metal fluid seal.

The top end of the independent screwed wellhead may further include at least one radial groove for receiving an elastomeric O-ring for providing another fluid seal between the independent screwed wellhead and the drilling flange.

The invention further provides a drilling flange and an independent screwed wellhead, in combination, comprising a drilling flange having a generally annular flange body with a top end that terminates in a top flange for supporting a blowout preventer, an axial passageway having a diameter at least as large as an inner diameter of the independent screwed wellhead, and a bottom end having an annular shoulder on an outer surface of a sidewall that rotatably supports a lockdown nut for securing the drilling flange to the independent screwed wellhead, the bottom end including a frusto-conical contact surface; and an independent screwed wellhead comprising a top end to which the drilling flange is mounted, an inner surface of the top end including a contact surface complimentary with the frusto-conical contact surface of the drilling flange. When the drilling flange is mounted to the independent screwed wellhead and the lockdown nut is tightened, the frusto-conical contact surface is forced into sealing contact with the complimentary contact surface to provide the metal-to-metal fluid seal.

The invention also provides an independent screwed wellhead, comprising a top end for mating engagement with a bottom end of a flange to be mounted thereto, the top end comprising an annular groove for receiving a metal flange gasket that is compressed between the independent screwed wellhead and the flange, to provide a high-pressure metal-to-metal seal when the flange is mounted thereto.

The flange comprises a drilling flange having a bottom end with a peripheral annular shoulder for rotatably supporting a lockdown nut for securing the drilling flange to the independent screwed wellhead.

A radial groove in an inner sidewall of the top end of the independent screwed wellhead receives an elastomeric O-ring that cooperates with a sidewall of the flange to provide another fluid seal between the independent screwed wellhead and the flange.

The invention further comprises an independent screwed wellhead, having a top end for mating engagement with a bottom end of a flange to be mounted thereto, the top end comprising a machined surface for mating engagement with a complementary frusto-conical surface of a flange mounted thereto, to provide a high-pressure metal-to-metal seal between the flange and the high pressure seal. The machined surface and the complementary frusto-conical surface are each offset from an axial plane of the independent screwed wellhead by 4°–10°.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

In general, the invention provides a drilling flange and an independent screwed wellhead for use in hydrocarbon well drilling. A metal-to-metal seal between the drilling flange and the independent screwed wellhead supplements elastomeric O-rings to provide a fluid seal resistant to environmental hazards. The metal-to-metal seal may be provided by a metal ring gasket seated in an annular groove. Alternatively, the metal-to-metal seal may be provided by contacting metal surfaces of the drilling flange and the independent screwed wellhead, which are machined to required tolerances. The metal-to-metal seal ensures that the fluid seal between the flange body and the wellhead remains secure in the event that the elastomeric O-rings are damaged. The drilling flange and complementary independent screwed wellhead in accordance with the invention ensures that a fluid seal is maintained at the wellhead even in the event of a fire on the wellhead.

Figure 1:
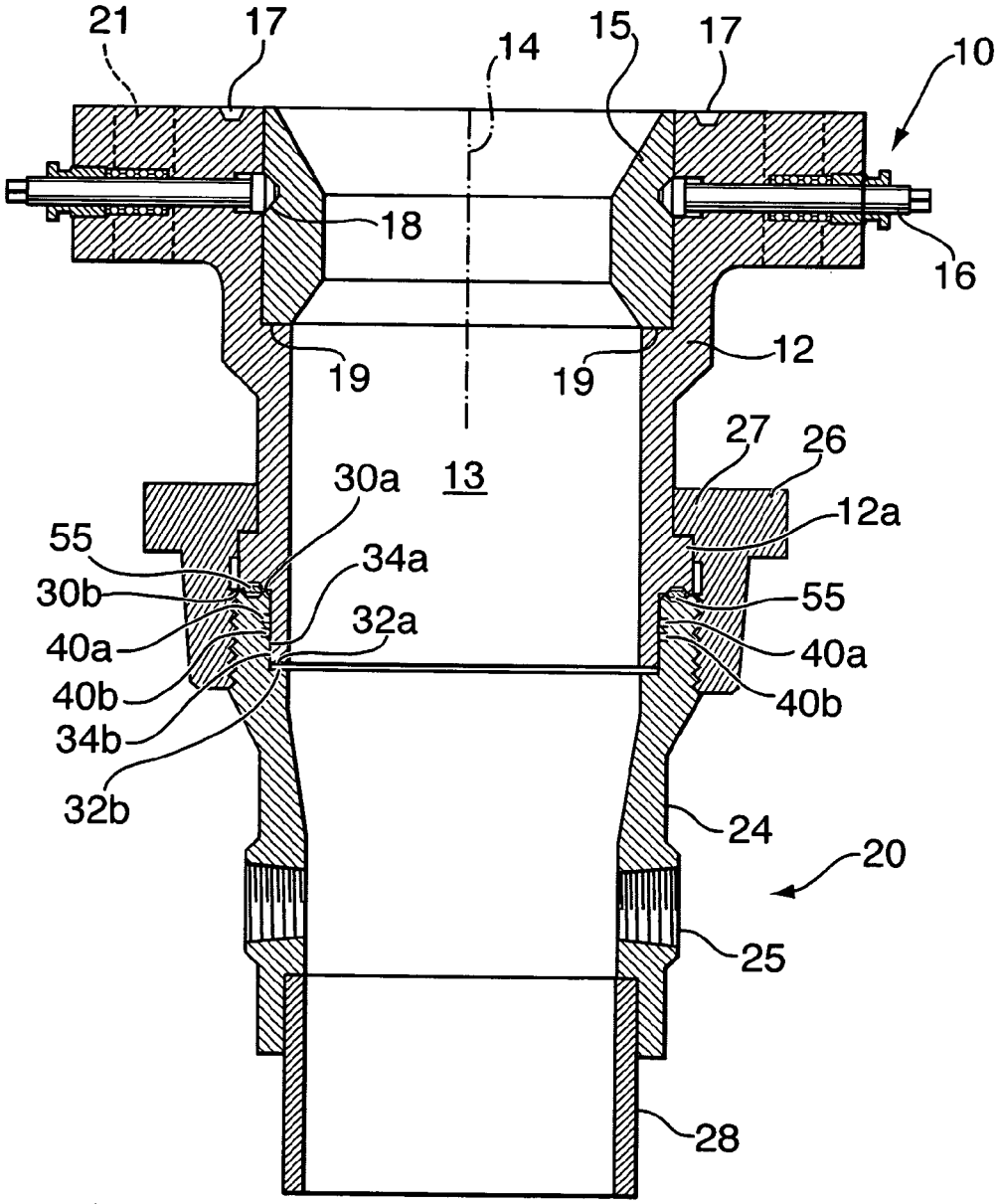
FIG. 1 is a cross-sectional view of a drilling flange mounted to an independent screwed wellhead in accordance with a first embodiment of the invention.

FIG. 1 illustrates a drilling flange 10 mounted to an independent screwed wellhead 20 in accordance with a first embodiment of the invention. The drilling flange 10 includes a generally annular flange body 12 and an axial passageway 13 through the annular flange body 12 which is aligned with a drilling axis 14. The axial passageway 13 has a diameter that is at least as large as the diameter of a passageway through the wellhead 20.

The drilling flange 10 supports a wear bushing 15, which is preferably constructed of hardened steel to withstand the wear caused by a rotating drill string (not shown). The wear bushing 15 rests on an annular shoulder 19 and is locked in place by a plurality of radial locking pins 16 having beveled heads that engage a peripheral groove 18 in an outer surface of the wear bushing 15. The locking pins 16 are received in threaded radial bores through a top end of the annular flange body 12. The locking pins 16 can be backed-off to permit the wear bushing 15 to be removed for servicing or replacement. The drilling flange 10 also includes a flange gasket groove 17 on the top surface of the drilling flange 10, and through bores 21 that permit attachment of a blowout preventer (BOP) or other pressure containment spool (not shown).

The wellhead 20 includes an annular wellhead body 24. The wellhead body 24 is secured to a surface casing 28 that surrounds an outer periphery of the well bore at ground level. The wellhead body 24 includes threaded ports 25 for supporting plugs or valves, in a manner well known in the art.

A lockdown nut 26 secures the drilling flange 10 to the wellhead 20. The lockdown nut 26 may be a hammer union, for example. The lockdown nut 26 ensures that the drilling flange 10 is tightly secured to the wellhead 20 while permitting the drilling flange to be rapidly mounted to, or removed from, the wellhead 20. As shown in FIG. 1, an outer sidewall at a bottom end of the drilling flange 10, includes an annular shoulder 12*a* that rotatably supports an annular portion 27 of the lockdown nut 26.

The drilling flange 10 has an upper abutment surface 30*a*, a lower abutment surface 32*a* and a lateral contact surface 34*a*. The wellhead 20 also has a corresponding upper abutment surface 30*b*, a corresponding lower abutment surface 32*b* and a corresponding lateral contact surface 34*b* which mate with the respective surfaces of the drilling flange as shown in FIG. 1. The lateral contact surfaces 34*a*, 34*b* are cylindrical in this embodiment.

Two elastomeric O-rings 40*a,b* are received in radial grooves at the interface of the lateral contact surfaces 34*a*, 34*b*. The radial grooves are received in grooves in the lateral contact surface 34*b*. These O-rings 40*a,b* provide a fluid seal between the drilling flange 10 and the wellhead 20. A person skilled in the art will readily appreciate that the number and precise position of the O-rings may be varied.

In addition to the elastomeric O-rings 40*a,b*, a fluid seal is also provided between the drilling flange 10 and the wellhead 20 by a metal ring gasket 55 that provides a metal-to-metal seal. The metal ring gasket 55 is preferably made of a type of steel that retains its mechanical properties at high temperatures. If a fire erupts in or around the well, the elastomeric O-rings 40*a,b* are susceptible to damage. The metal-to-metal seal is designed to provide a fluid-tight seal, even after the elastomeric O-rings 40*a,b* have been damaged or destroyed. Thus, the drilling flange 10 is designed to maintain the fluid-tight seal with the wellhead 20 even after exposure to the high temperatures associated with well fires.

It should be noted that the embodiments of the invention are operable without any elastomeric O-rings. A metal-to-metal seal is sufficient although persons skilled in the art will appreciate that the primary utility of the metal-to-metal seal is as a backup for the O-ring seals in the event of fire.

Figure 2:
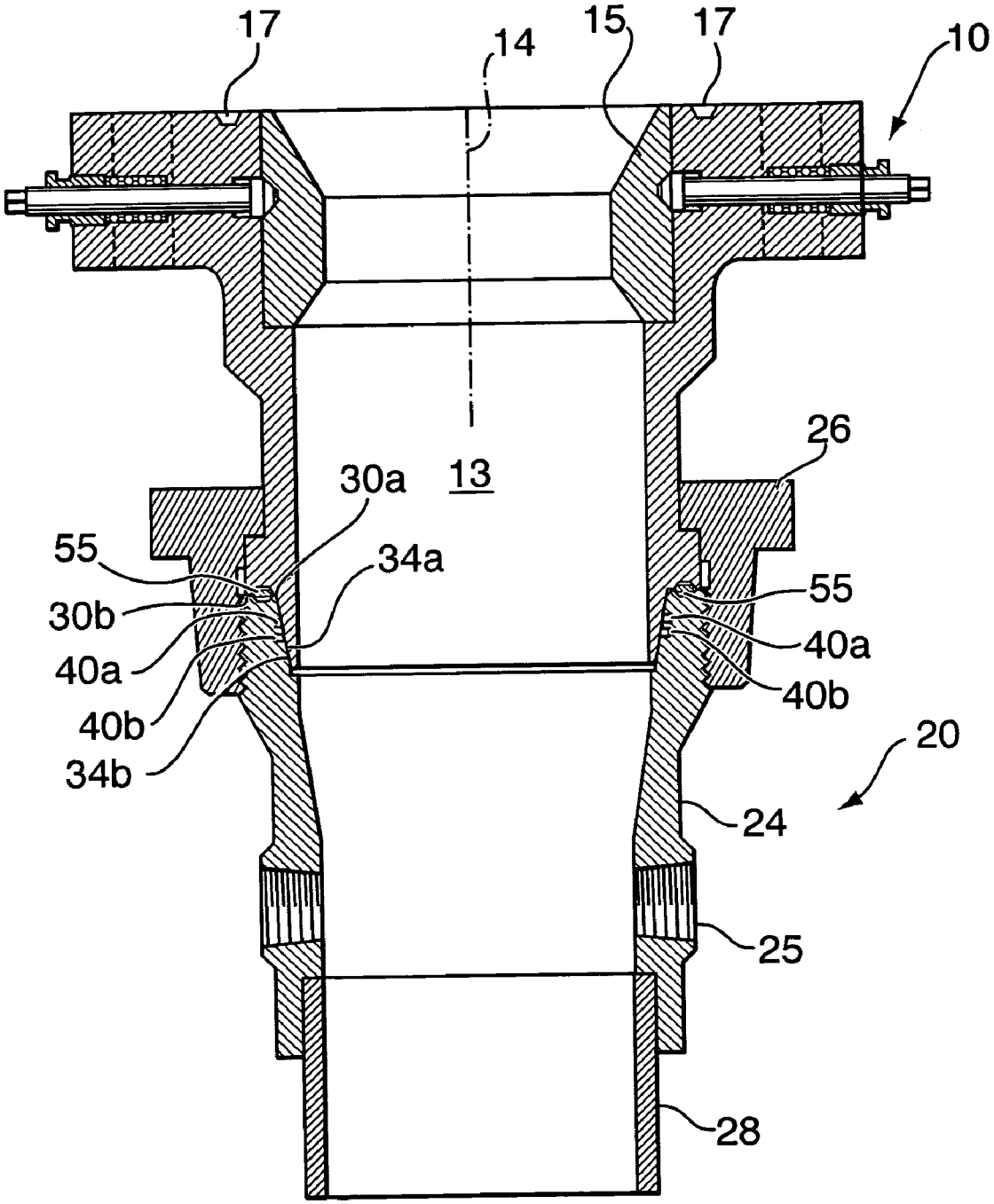
FIG. 2 is a cross-sectional view of a drilling flange mounted to an independent screwed wellhead in accordance with a second embodiment of the invention.

FIG. 2 is a cross-sectional view of a second embodiment of a drilling flange and the independent screwed wellhead 20. The lateral contact surfaces 34*a*, 34*b* of the drilling flange 10 are frusto-conical. The frusto-conical axial contact surfaces 34*a*, 34*b* converge in the downward, drilling direction. Two O-rings 40*a,b* are seated along the frusto-conical surface 34*b* in radial grooves cut into the wellhead. A metal ring gasket 55 is seated in a groove in the upper abutment surface 30*b*.

Figure 3:
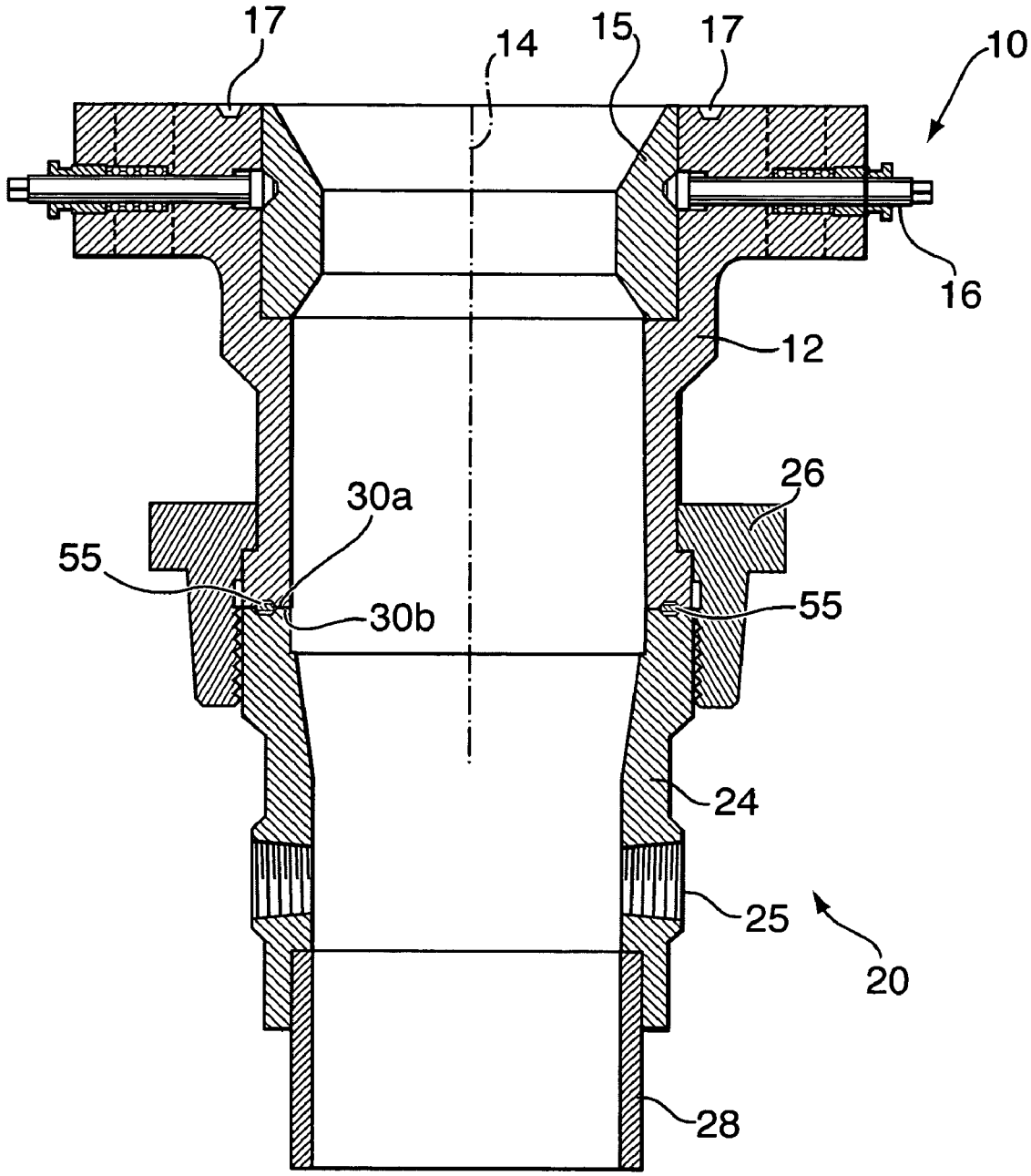
FIG. 3 is a cross-sectional view of a drilling flange mounted to an independent screwed wellhead in accordance with a third embodiment of the invention.

FIG. 3 depicts a third embodiment of the drilling flange 10 and the independent screwed wellhead 20. In this embodiment, a metal ring gasket 55 is seated in a groove located at the interface of the upper abutment surfaces 30*a*, 30*b*. The groove is cut into both the upper abutment surface 30*a* of the drilling flange 10 and the upper abutment surface 30*b* of the wellhead 20. An upper half of the metal ring gasket is received in the groove formed in the upper abutment surface 30*a* and a lower half on the ring gasket is received in the groove formed in the upper abutment surface 30*b*.

Figure 4:
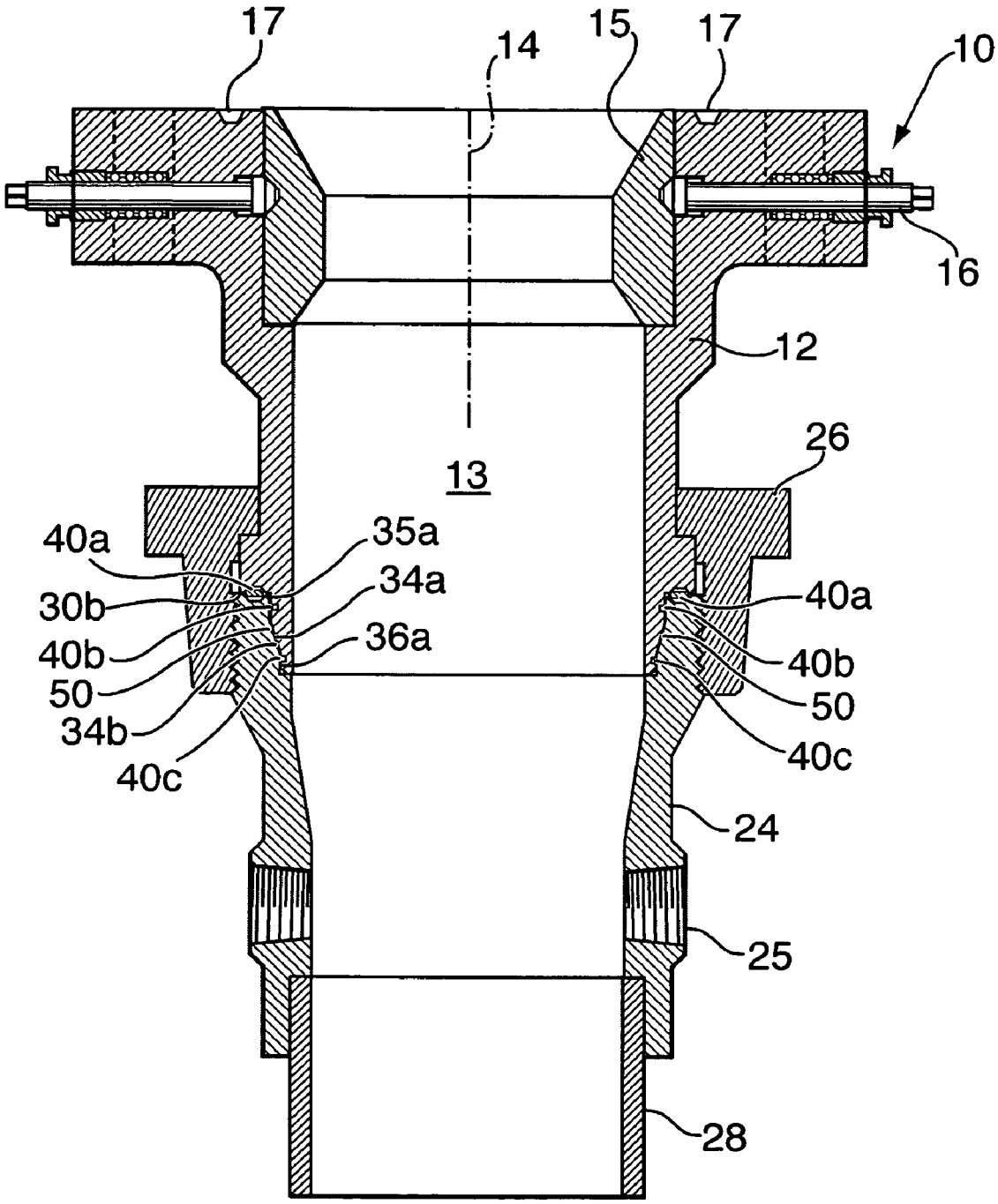
FIG. 4 is a cross-sectional view of a drilling flange mounted to an independent screwed wellhead in accordance with a fourth embodiment of the invention.

FIG. 4 shows a fourth embodiment of the invention. In this fourth embodiment, there are three O-rings 40*a–c*, as well as a metal-to-metal surface seal 50, which provide the fluid seal between the drilling flange 10 and the wellhead 20. O-ring 40*a* is located in a groove in the upper abutment surface 30*b* of the wellhead 20. The second O-ring 40*b* is located in a radial groove in an upper cylindrical surface 35*a* of the drilling flange 10. The third O-ring 40*c* is located in a radial groove in a lower cylindrical surface 36*a* of the drilling flange 10. The metal-to-metal surface seal 50 is located along the frusto-conical contact surfaces 34*a*, 34*b*. The metal-to-metal seal 50 is achieved when the two smooth, flat, parallel contact surfaces 34*a*, 34*b*, which are machined to a required tolerance, are forced together by a downward force exerted by the lockdown nut 26.

Figure 5:
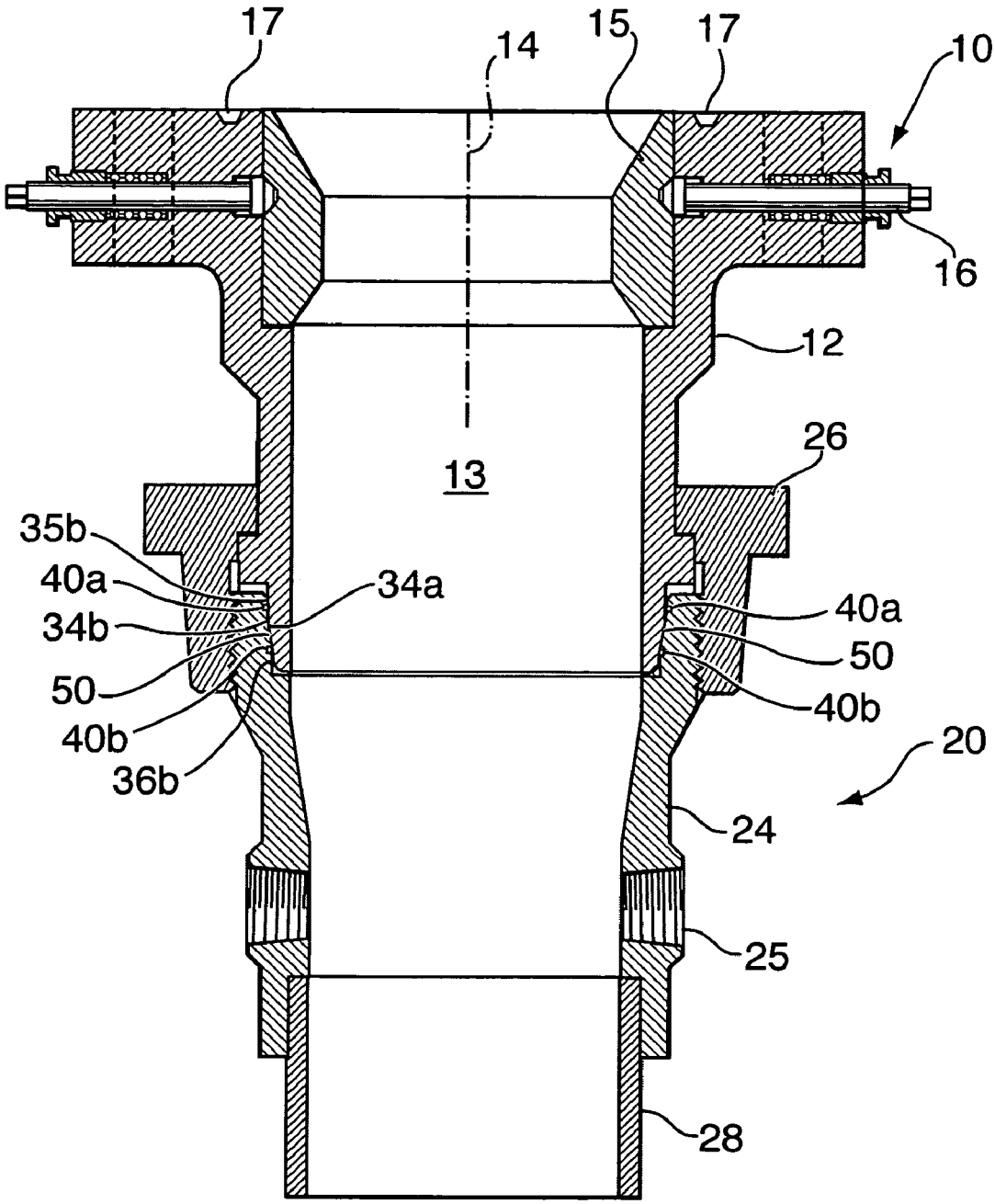
FIG. 5 is a cross-sectional view of a drilling flange mounted to an independent screwed wellhead in accordance with a fifth embodiment of the invention.

FIG. 5 shows a fifth embodiment of the invention. In this fifth embodiment, two O-rings 40*a,b* and a metal-to-metal surface seal 50 provide a fluid seal between the drilling flange 10 and the wellhead 20. A first O-ring 40*a* is located in a radial groove in an upper cylindrical surface 35*b* of the wellhead 20. The second O-ring 40*b* is located in a radial groove in a lower cylindrical surface 36*b* of the wellhead 20. The metal-to-metal surface seal 50 is achieved when the frusto-conical axial contact surfaces 34*a*, 34*b* which are machined at about 4°–10° from the vertical at required tolerances, are forced together by downward pressure exerted by the lockdown nut 26. In this embodiment, the contact surfaces are respectively machined at 7° from vertical.

Figure 6:
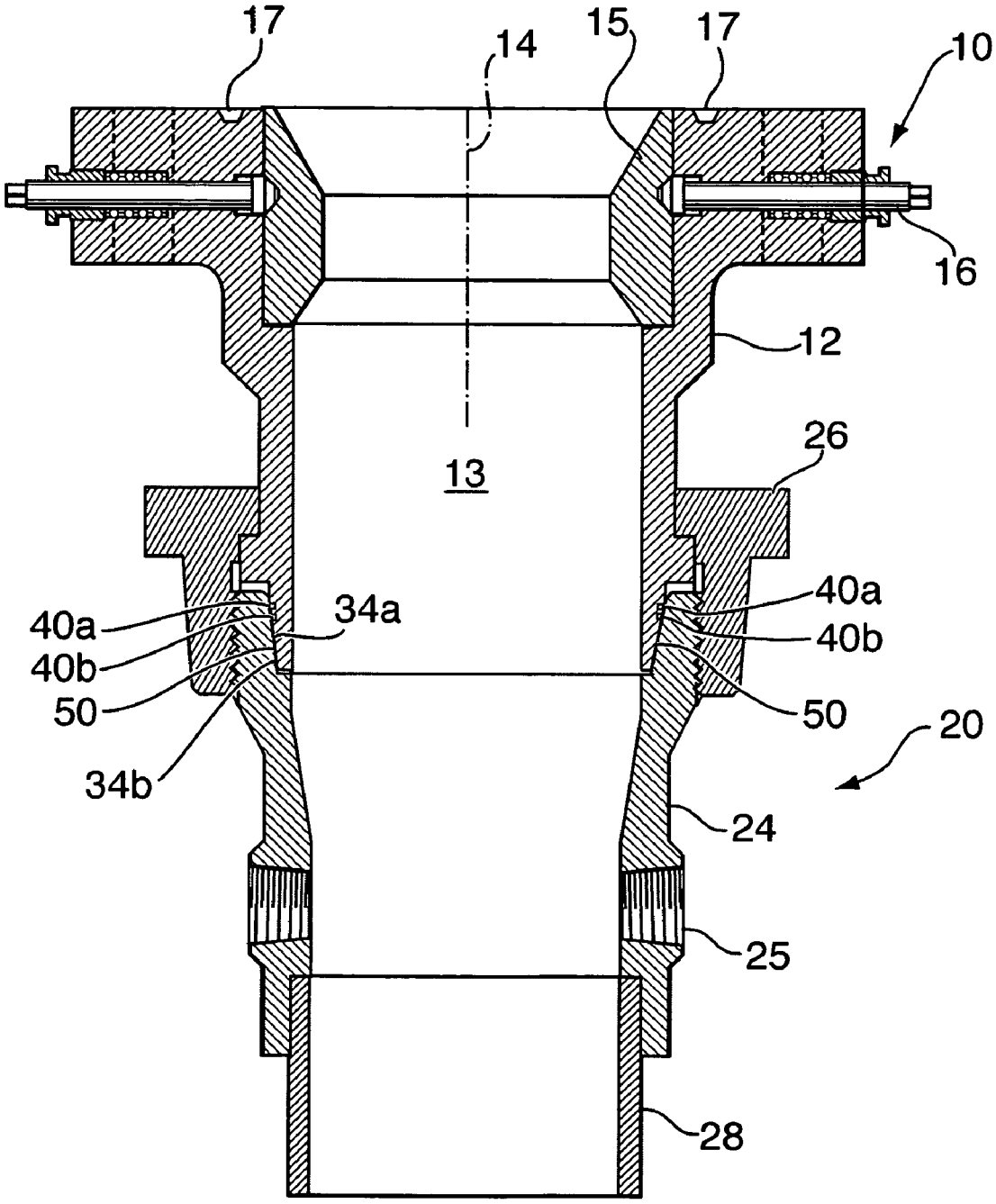
FIG. 6 is a cross-sectional view of a drilling flange mounted to an independent screwed wellhead in accordance with a sixth embodiment of the invention.

FIG. 6 illustrates a sixth embodiment of the invention. In this sixth embodiment, the fluid seal between the drilling flange 10 and the wellhead 20 is provided by two O-rings 40*a,b* and a metal-to-metal surface seal 50. The two O-rings 40*a,b* are seated in respective grooves in the frusto-conical axial contact surface 34*a*. The metal-to-metal surface seal 50 is achieved below the O-rings when the frusto-conical axial contact surfaces 34*a*, 34*b*, which are machined to required tolerances, are forced into contact by pressure exerted by the lockdown nut 26.

Figure 7:
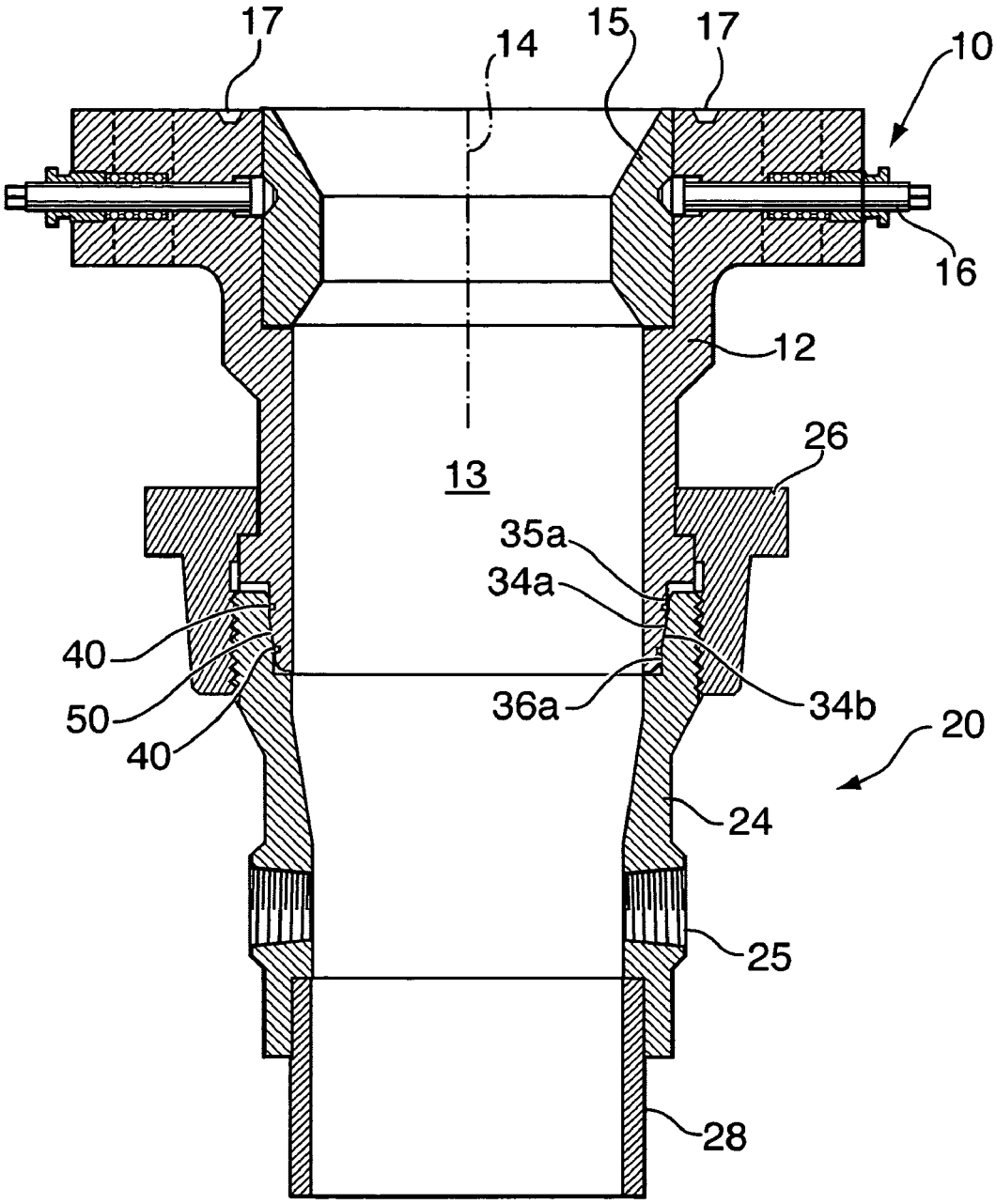
FIG. 7 is a cross-sectional view of a drilling flange mounted to an independent screwed wellhead in accordance with a seventh embodiment of the invention.

FIG. 7 shows a seventh embodiment of the invention. In this seventh embodiment, two O-rings 40*a,b* and a metal-to-metal surface seal 50 provide the fluid seal between the drilling flange 10 and the wellhead 20. The first O-ring 40*a* is seated in a radial groove located in an upper cylindrical surface 35*a* of the drilling flange 10. The second O-ring 40*b* is seated in a radial groove located in a lower cylindrical surface 36*a* of the drilling flange. The metal-to-metal surface seal 50 is formed when the frusto-conical contact surfaces 34*a*, 34*b*, which, as described above, are machined to required tolerances, are forced together by pressure exerted when the lockdown nut 26 when it is tightened to achieve the fluid seal.

The drilling flange 10 and the independent screwed wellhead are used to drill a wellbore that communicates with one or more subterranean production zones using a drilling rig, in a manner that is well known in the art. In use, a drill string of the drilling rig (not shown) is inserted through the wear bushing 15, along the drilling axis 14. The drill string is rotated to drive a drill bit connected to a bottom end of the drill string. The drill bit bores through the earth to form the wellbore. As the drill bit advances, joints are added to the drill string as required. The metal-to-metal seal between the drilling flange 10 and the independent screwed well ensures that a fluid seal is maintained between them at all times, even in the event of a fire at the wellhead.

As will be appreciated by persons skilled in the art, the drilling flange 10 can be rapidly mounted to a screwed independent wellhead 20, or removed from the wellhead 20. Since the wear bushing 15 is replaceable, the drilling flange 10 has a long service life and is therefore economical to use. Furthermore, because the drilling flange 10 provides a reliable metal-to-metal fluid seal, the drilling flange 10 can be safely used even for applications where there is danger of a fire or other environmental hazard at the wellhead that could potentially cause the O-rings to malfunction.

The embodiments of the invention described above are therefore intended to be exemplary only. The scope of the invention is intended to be limited solely by the scope of the appended claims.

We claim:

1. A drilling flange for use with an independent screwed wellhead, comprising:

a flange body having a generally annular shape, the flange body including an axial passageway with an internal diameter at least as large as a passageway through the wellhead, and a bottom end adapted to be mounted to a top of the independent screwed wellhead, the bottom end of the flange body including an annular shoulder for rotatably supporting a lockdown nut for securing the flange body to the wellhead; and a metal-to-metal seal for providing a fluid seal between the flange body and the wellhead, the metal-to-metal seal comprising a metal ring gasket.

2. A drilling flange as claimed in claim 1 further comprising an elastomeric seal for providing a further fluid seal between the flange body and the wellhead.

3. A drilling flange as claimed in claim 2 wherein the elastomeric seal is an O-ring.

4. A drilling flange as claimed in claim 1 further comprising a wear bushing for guiding a drill string through the wellhead.

5. A drilling flange as claimed in claim 4 wherein the wear bushing is removably secured to a top of the axial passageway to facilitate replacement of the wear bushing.

6. A drilling flange as claimed in claim 5 wherein the wear bushing includes a peripheral groove in an outer surface thereof, and the wear bushing is removably secured to the flange body by a plurality of locking screws received in threaded radial bores through a top end of the flange body.

7. A drilling flange as claimed in claim 4 further comprising a top flange for mounting a blowout preventer to the independent screwed wellhead.

8. A drilling flange for use with an independent screwed wellhead, comprising:

a flange body having a generally annular shape, the flange body including an axial passageway with an internal diameter at least as large as a passageway through the wellhead, and a bottom end adapted to be mounted to a top of the independent screwed wellhead, the bottom end of the flange body including an annular shoulder for rotatably supporting a lockdown nut for securing the flange body to the wellhead; and a metal-to-metal seal for providing a fluid seal between the flange body and the wellhead, the metal-to-metal seal comprising a first metal contact surface on the bottom end of the flange body that cooperates with a second metal contact surface on the independent screwed wellhead, the first and second metal contact surfaces being forced together by the lockdown nut to provide the metal-to-metal seal when the flange body is mounted to the independent screwed wellhead.

9. A drilling flange as claimed in claim 8 wherein the bottom end of the flange body comprises a hollow frusto-conical portion of converging radius in the downward axial direction, the frusto-conical portion being located between an upper abutment surface and a lower abutment surface, and the frusto-conical portion comprises a smooth metal contact surface for forming the metal-to-metal seal with the second metal contact surface of the independent screwed wellhead.

10. A drilling assembly comprising:

an independent screwed wellhead secured to a well;

a drilling flange including a flange body having a generally annular shape, the flange body including an axial passageway with an internal diameter at least as large as a passageway through the wellhead, the flange body having a bottom end adapted to be mounted to a top of the independent screwed wellhead, a sidewall of the bottom end of the flange body including an annular shoulder for supporting a lockdown nut, the lockdown nut securing the flange body to the wellhead, and a metal-to-metal seal for providing a fluid seal between the flange body and the wellhead.

11. A drilling assembly as claimed in claim 10 further comprising an elastomeric seal for providing a further fluid seal between the flange body and the wellhead.

12. A drilling assembly as claimed in claim 11 wherein the independent screwed wellhead further comprises a lower abutment surface, an upper abutment surface, and a lateral contact surface between the lower abutment surface and the upper abutment surface, the drilling flange contacting the wellhead at the lower abutment surface, the upper abutment surface and the lateral contact surface.

13. A drilling assembly as claimed in claim 12 wherein the lateral contact surface is cylindrical.

14. A drilling assembly as claimed in claim 12 wherein the metal-to-metal seal is located along the lower abutment surface.

15. A drilling assembly as claimed in claim 12 wherein the metal-to-metal seal is located along the upper abutment surface.

16. A drilling assembly as claimed in claim 15 wherein the metal-to-metal seal comprises a metal ring gasket.

17. A drilling assembly as claimed in claim 12 wherein the radial contact surface is frusto-conical.

18. A method of drilling a well bore that communicates with at least one hydrocarbon formation comprising:

securing an independent screwed wellhead to a surface casing for the well bore;

attaching a drilling flange to the independent screwed wellhead, the drilling flange comprising a generally annular flange body having a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to a top of the independent screwed wellhead such that a metal-to-metal seal is formed between the drilling flange and the independent screwed wellhead to provide a fluid seal between the drilling flange and the independent screwed wellhead even in the event of a fire on the wellhead;

inserting a drill string through an axial passageway of the drilling flange; and rotating the drill string to drill down to the at least one hydrocarbon formation.

19. A drilling flange for an independent screwed wellhead, comprising a generally annular flange body having a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to a top of the independent screwed wellhead, the bottom end including an annular groove for receiving a metal ring gasket for providing a metal-to-metal seal between the drilling flange and the independent screwed wellhead.

20. A drilling flange and an independent screwed wellhead in combination, comprising:

the drilling flange comprising a generally annular flange body having a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to the independent screwed wellhead, the bottom end including a first annular groove for receiving an upper half of a metal ring gasket; and the independent screwed wellhead comprising a top end to which the drilling flange is mounted, the top end including a second, complimentary annular groove for receiving a lower half of the metal ring gasket;

whereby when the drilling flange is mounted to the independent screwed wellhead and the lockdown nut is tightened, the metal ring gasket is compressed in the first and second annular grooves to provide a metal-to-metal fluid seal.

21. The combination claimed in claim 20 wherein the top end of the independent screwed wellhead further comprises at least one radial groove for receiving an elastomeric O-ring for providing another fluid seal between the independent screwed wellhead and the drilling flange.

22. A drilling flange and an independent screwed wellhead, in combination, comprising:

the drilling flange comprising a generally annular flange body having a top end that terminates in a top flange for supporting a blowout preventer, an axial passageway having a diameter at least as large as an inner diameter of the independent screwed wellhead, and a bottom end having an annular shoulder on an outer surface of a sidewall thereof that rotatably supports a lockdown nut for securing the drilling flange to the independent screwed wellhead, the bottom end including a frusto-conical contact surface; and the independent screwed wellhead comprising a top end to which the drilling flange is mounted, an inner surface of the top end including a contact surface complimentary with the frusto-conical contact surface of the drilling flange;

whereby when the drilling flange is mounted to the independent screwed wellhead and the lockdown nut is tightened, the frusto-conical contact surface is forced into sealing contact with the complimentary contact surface to provide a metal-to-metal fluid seal.

23. The combination claimed in claim 22 wherein the top end of the independent screwed wellhead further comprises at least one radial groove for receiving an elastomeric O-ring for providing another fluid seal between the independent screwed wellhead and the drilling flange.

24. An independent screwed wellhead, comprising an annular wellhead body secured to a surface casing that surrounds an outer periphery of a well bore at ground level, the wellhead body including threaded ports for supporting plugs or valves, a top end for mating engagement with a bottom end of a flange to be mounted thereto, the top end comprising an upper abutment surface, a lower abutment surface and a lateral contact surface which mate with the respective surfaces of the flange, and an annular groove in the upper abutment surface for receiving a lower half of a metal ring gasket, an upper half of the metal ring gasket being received in a corresponding groove formed in a corresponding abutment surface of the flange, the metal ring gasket beng compressed between the independent screwed wellhead and the flange by a lockdown nut for securing the flange to the independent screwed wellhead to provide a high-pressure metal-to-metal seal when the flange is mounted thereto.

25. An independent screwed wellhead as claimed in claim 24 wherein the flange comprises a drilling flange having a bottom end with a peripheral annular shoulder for rotatably supporting the lockdown nut for securing the drilling flange to the independent screwed wellhead.

26. An independent screwed wellhead as claimed in claim 24 further comprising a radial groove in an inner sidewall of the top end of the independent screwed wellhead, the radial groove receiving an elastomeric O-ring that cooperates with a sidewall of the flange to provide another high-pressure seal between the independent screwed wellhead and the flange.

* * * * *